United States Patent [19]

Vertegaal

[11] 4,069,756

[45] Jan. 24, 1978

[54] SQUEEGEE DEVICE

[75] Inventor: Jacobus Gerardus Vertegaal, Boxmeer, Netherlands

[73] Assignee: Stork Amsterdam B.V., Amstelveen, Netherlands

[21] Appl. No.: 642,343

[22] Filed: Dec. 19, 1975

Related U.S. Application Data

[63] Continuation-in-part of Ser. No. 453,812, March 22, 1974, abandoned.

[30] Foreign Application Priority Data

Apr. 5, 1973 Netherlands ..... 7304774

[51] Int. Cl.[2] ..... B41F 15/44

[52] U.S. Cl. ..... 101/120

[58] Field of Search ..... 101/116, 119, 120, 123, 101/124, 157, 169; 15/256.5, 256.51; 118/213

[56] References Cited

U.S. PATENT DOCUMENTS

| | | | |
|---|---|---|---|
| 2,387,390 | 10/1945 | Goodwin | 101/120 |
| 3,592,132 | 7/1971 | Weber | 101/119 |
| 3,795,188 | 3/1974 | Giani | 101/119 |
| 3,886,861 | 6/1975 | Anselrode | 101/119 |
| 3,930,445 | 1/1976 | Jaffa | 101/120 |

*Primary Examiner*—R.E. Suter
*Attorney, Agent, or Firm*—Edmund M. Jaskiewicz

[57] ABSTRACT

A squeegee device for a cylindrical stencil comprising a fitting and a thin flexible strip has one edge secured in said fitting. The opposite free edge of the flexible strip has a rigidifying, reinforcing member thereon, such as a cylindrical rod which is in contact with the inner wall of the stencil.

4 Claims, 6 Drawing Figures

SQUEEGEE DEVICE

RELATED APPLICATION

This application is a continuation-in-part application of the copending application Ser. No. 453,812 filed Mar. 22, 1974 by the same-named applicant, now abandoned.

BACKGROUND OF THE INVENTION

The present invention relates to a squeegee device for a cylindrical stencil of a rotary screen printing machine, the device consisting of a flexible squeegee strip one edge of which is secured in a fitting whereas the other, free edge in operation, cooperates with the inner wall of the stencil. Such a device is known and is disclosed in co-pending patent application Ser. No. 383,155 filed on July 28, 1973 issued on Jan. 20, 1976 as U.S. Pat. No. 3,933,093, CIP of patent application Ser. No. 811,787 filed on Apr. 1, 1969, now abandoned.

A normal metal squeegee blade has a trailing edge which is in contact with the innerwall of the screen cylinder. This edge will yield to local pressure or uneven parts so that the trailing edge will not remain straight. There may also be other reasons for the trailing edge not to remain one straight line. These local flexures of the trailing edge are reflected in the printing result which renders the product of minor quality. By rigidifying the trailing edge of the squeegee blade, this disadvantage is avoided.

The rigidifying element may either be on the upper side of the squeegee blade or against the lower face. In the last mentioned embodiment, there is the possibility of making this element cylindrical, such that the nip-angle will remain constant not withstanding an increase or decrease in pressure exercised by the squeegee blade.

In operation, a quantity of paste or paint supplied within the stencil is pressed through the stencil perforations onto the material which contacts the outside of the stencil, e.g., a web of fabric or a paper strip. The squeegee device has a double function since adjusting the squeegee strip will determine both the quantity (or output) of the paste reaching the material through the stencil and the penetration depth of the printing paste into the material (in printing textiles).

The above-mentioned quantity or output depends on the angle between the squeegee strip and the inner wall of the stencil. The penetration depth depends on the force with which the squeegee strip is pressed against the inner surface of the stencil. In the conventional squeegee devices these two functions cannot be separated but are dependent upon each other. If, for example, it is desired to change the squeegee angle in order to influence the quantity of paste which is pressed through the stencil, this change of angle will mostly only be achieved by means of the compressive force. Inversely, when the penetration depth must be varied, one has to adjust the compressive force of the squeegee strip, which automatically results in a change of the squeegee angle and consequently a change of the output or applied coating.

SUMMARY OF THE INVENTION

The object of the present invention is to render mutually independent the two aforementioned functions, namely, a. Adjustment of the output or applied coating, that is to say of the quantity of paste pressed through the stencil;

b. Adjustment of the penetration depth of the paste into the material.

This object is attained according to this invention by the arrangement that the free edge of the squeegee strip is integral with a rigid, reinforcing member which may be cylindrical in shape. This member constitutes a reinforcement or a rigidification of the free edge of the squeegee strip, so that a particular penetration depth is obtained. In order to influence independently thereof the quantity of paint applied, the squeegee angle should be adjustable without noticeably changing the force acting upon the squeegee. This may be achieved in the way described in the co-pending Patent Application Ser. No. 230,330 filed on Feb. 29, 1972 issued on June 3, 1975 as U.S. Pat. No. 3,886,861, or by using a very slack squeegee strip, i.e., a minimum of force is applied on the squeegee against the stencil.

According to a modification, the reinforcing member is cylindrical and bears in operation directly against the inner wall of the stencil. Due to these features a constant squeegee angle is obtained independent of the position of the squeegee strip which latter position is influenced by the adjusted compressive force. The squeegee strip itself no longer contacts the inner wall of the stencil.

The present invention relates particularly to a squeegee device wherein the squeegee strip consists of a thin metal strip according to the first mentioned pending patent application Ser. No. 383,155. In such a device the member may have, at least in its part positioned in front of the inner wall of the stencil, a cylindrical shape, i.e., at the forward portion thereof with respect to the direction of rotation of the stencil and adjacent the stencil inner wall. A change as to shape and position of this squeegee strip owing to a change of the compressive force, entails actually a tilting of the rod, without giving rise, however, to a change of the squeegee angle (and consequently of the output), which angle is determined by the cylindrical shape of the rod.

The member consists preferably of a rod with a circular cross-section. A rod-shaped member has the advantage that local unevenesses in the material to be printed, e.g. naps or dots (in textiles) do not influence, or at any rate have a lesser influence on, the uniformity of the printing operation proper. Due to the higher weight and the greater rigidity of the rod with respect to the flexible squeegee strip, the aforementioned dots hardly cause a modification of the manner in which the rod and the wall of the stencil contact the material to be printed.

DRAWINGS

Figure 4:
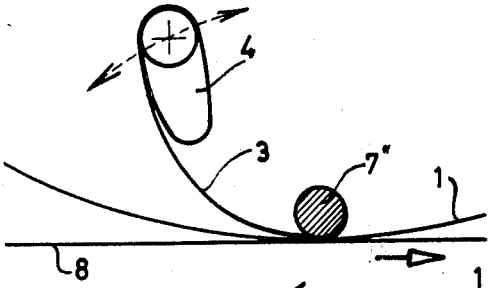
FIG. 4 is a view similar to FIG. 1 and shows another modification of the squeegee device.
Figure 4A:
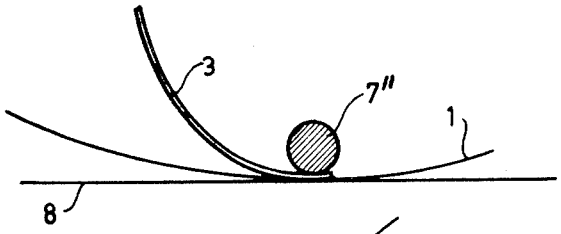
Figure 5:
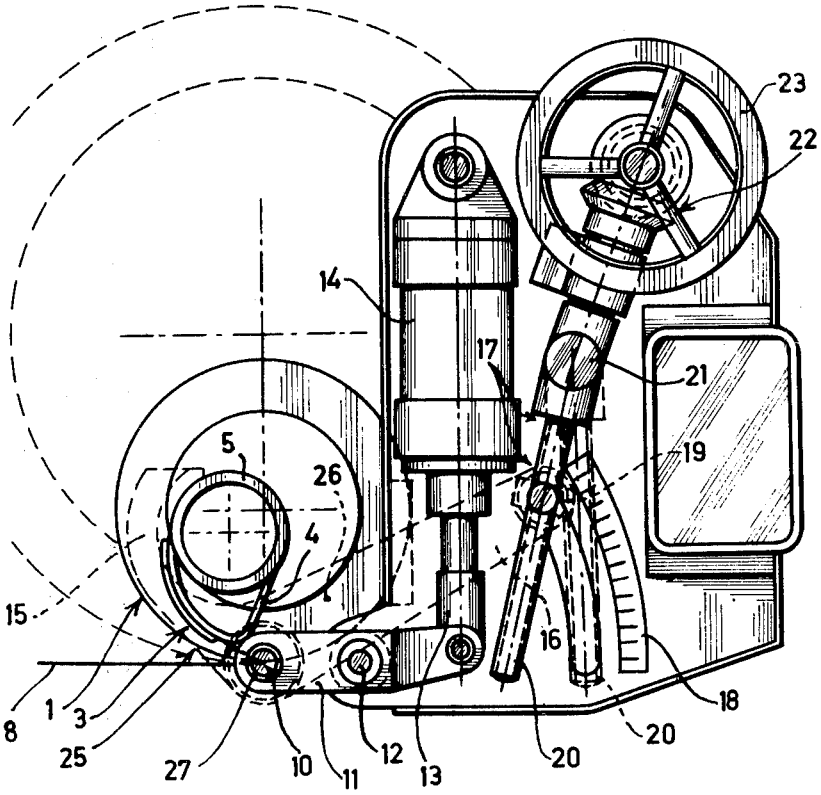

FIG. 4*a* is a portion of the view of FIG. 4 in enlarged scale showing the mounting of the cylindrical rod 7″ on the upper side of the strip 3; and FIG. 5 is a side elevational view of the adjusting structure for varying the angle between the squeegee strip and stencil inner wall without changing the compressive force.

DESCRIPTION OF PREFERRED EMBODIMENTS

Figure 1:
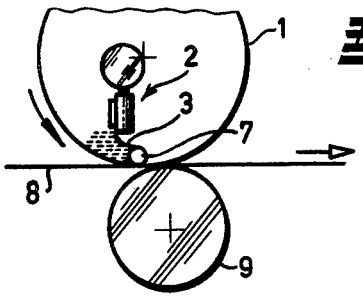
FIG. 1 is a cross-sectional view through a part of a screen printing machine showing a squeegee device according to the present invention.

The squeegee device according to the present invention is meant for a screen printing machine of the type as e.g. described in the aforementioned pending CIP application Ser. No. 383,155 and is further provided with a plurality of cylindrical stencils one of which is shown in FIG. 1. A squeegee device 2 is mounted within this stencil 1, said device consisting of a flexible squeegee device strip 3 one edge of which is secured in a fitting 4. This fitting is suspended from a carrier 5 which consists of a tube through which the paint from the outside can be supplied to the space A, situated before the squeegee strip 3.

The edge of the squeegee strip 3, which is turned away from the side secured in the fitting 4 is denoted by 6 and is integral with a reinforcing member 7 which may be a portion of the strip. This member bears in operation directly against the inner wall of the stencil 1.

Figure 2:
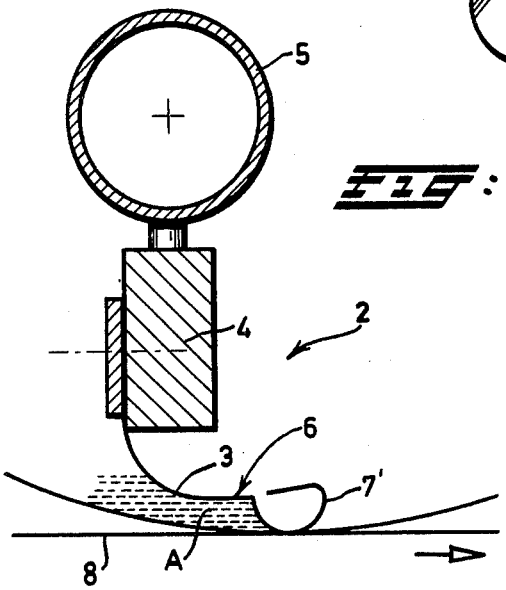
FIGS. 2 and 3 are views similar to FIG. 1 and show on an enlarged scale two modifications of the squeegee device according to FIG. 1.

In the embodiment as in FIG. 2 the member 7′ consists of a channel-shaped or sleeve-shaped, bent, hollow body which is cylindrical in its part situated in front of the inner wall of the stencil. In the embodiment according to FIG. 3 this member consists of a rod 7″ with a circular cross-section.

In operation stencil 1 is pressed by the squeegee device 2 against the web 8, while this web may be supported, by a (not shown) endless belt or supporting blanket. On its underside web 8 is supported by a roller 9 at a location slightly beyond the printing area proper of the stencil 1. This printing area lies slightly below and at the same time slightly before the area in which the member 7 contacts the wall of the stencil 1.

Due to the application of member 7 the mostly two-fold function of the squeegee strip 3 is split up since this member 7 makes an unvariable wedge angle with the inner wall of the stencil 1. This angle determines the quantity of paint applied to the material 8. The other function of the squeegee strip 3, namely the penetration depth can be determined by means of the force by which the member 7 is pressed against the inner wall of the stencil 1. The angular position of the strip 3 does no longer influence the applied quantity of paint.

In the modification according to FIG. 4 the squeegee strip 3 remains in contact with the inner wall of the stencil 1 while the cylindrical rod 7″ is mounted on the upper side of the strip 3 as shown in FIG. 4a.

Hereby a constant compressive force (and penetration depth) can be obtained. The angle between the squeegee strip and the inner wall of the stencil 1 can then be modified without changing the compressive force. For that purpose the material of the squeegee strip 3 is softly elastic. The adjustment of the squeegee strip may also be effected by tilting this strip around an axis coinciding with the edge of the strip, which bears against the inside of the stencil.

In FIG. 5 there is shown a part of the frame of the machine and a stencil 1 rotatably mounted in the frame. In each stencil an adjustable squeegee 3 is provided. This stencil is operated in a path 8 along which the material to be printed (e.g., a web of fabric or loose sheets of paper) is advanced. Each squeegee comprises a supporting member 5 with a fitting 4 for the squeegee strip. The member 5 is constructed in the usual way as a tube through which the printing paste is fed to the interior of the stencil 2. The supporting member 5 is hung at its two ends protruding from the stencil on adjustable suspension members 25 consisting of a lever 26 supported in in the frame. The lever 26 in this case constructed as a bell crank lever, has a pivotable axis 27 situated on the extension of a line along the edge 10 of the squeegee 3.

The pivotal axis 27 of the first lever 26 is supported in a second lever 11 allowing an adjustment in a vertical direction perpendicular to the printing path 8. For that purpose the second lever 11 has a pivotal axis 12 on the frame of the machine. The one end of the lever 11 carries the pivotal axis 27 of the first lever 26, while the other end via an operating rod 13 is connected with a fluid operating member 14, e.g., consisting of the usual pneumatic jack. The one end 15 of the first lever 26 carries the supporting member 5 of the squeegee 3 while the other end 16 cooperates with both an adjusting mechanism 17 and a graduated scale 18.

The mechanism 17 comprises a nut 19 connected with the end 16 of the bell crank member 26 and cooperating with a threaded rod 20 which via a universal joint 21 and a bevel gear in 22 is connected with a hand wheel 23. By turning this hand wheel 23 the rod 20 is rotated to move the nut 19 along the threaded rod 20 to rotate the lever 26 around its pivotal axis 27 which coincides with the line 10 of contact. The pivoting lever 26 thus moves the squeegee support 5 downwardly but at the same time imparts a sideward or lateral movement to the support. The downward and lateral components of movement reduce a pivoting movement of the entire support 3,4,5 about the pivot axis 27. As a result, the nip angle between the squeegee blade 3 and the inner surface of the stencil 1 is adjusted without any change in the compressive force of the squeegee strip. It is thus possible to adjust to any nip angle required or desired for a particular printing effect and to subsequently determine independently of the nip angle the compressive force of the squeegee strip via the lever 11, rod 13 and the operating member 14.

Figure 3:
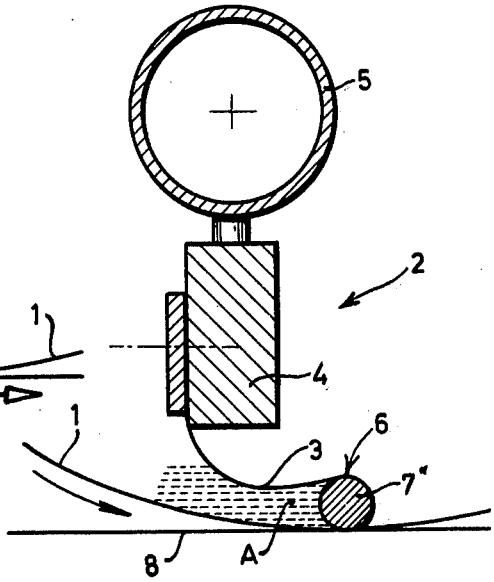

The squeegee device as hereinbefore described allows therefore to adjust both the quantity of paint applied and the penetration depth independently of one the other. The embodiments according to FIGS. 3 and 4 are advantageous in that local unevenesses in the web 8 have little if any influence on the uniformity of the printing proper.

It will be understood that this invention is susceptible to modification in order to adapt it to different usages and conditions, and accordingly, it is desired to comprehend such modifications within this invention as may fall within the scope of appended claims.

What is claimed is:

1. A squeegee device for a cylindrical stencil of a screen printing machine comprising a flexible squeegee strip comprising a thin metal strip for applying compressive force against the inner wall of the stencil, one edge of said strip being secured in a fitting and the other free edge of the strip protruding from the fitting, means on the free edge of the strip at least a portion of which bears directly against the inner wall of the stencil for rigidifying said free edge so the flexures of the free edge during printing are avoided and uniform contact of the free edge with the stencil is obtained.

2. A squeegee device as claimed in claim 1 wherein said portion is substantially cylindrical so that the compressive force exerted by the metal strip against the stencil is independent of an angle defined by said portion and the inner wall of the stencil.

3. A squeegee device as claimed in claim 1 wherein said means comprises a rod having a circular cross section so that the compressive force exerted by the metal strip against the stencil is independent of an angle defined by said portion and the inner wall of the stencil.

4. A squeegee device as claimed in claim 2 wherein said means comprises a sleeve-shaped bent hollow body formed by said free edge.

* * * * *